US005849681A

United States Patent [19]

Neumiller et al.

[11] Patent Number: 5,849,681

[45] Date of Patent: Dec. 15, 1998

[54] GLASS CLEANER WITH ENHANCED ANTI-STREAKING PROPERTIES

[75] Inventors: Phillip J. Neumiller; Shelly M. Ziemelis, both of Racine, Wis.

[73] Assignee: S. C. Johnson & Son, Inc., Racine, Wis.

[21] Appl. No.: 599,004

[22] Filed: Feb. 9, 1996

[51] Int. Cl.[6] ..... C11D 1/75

[52] U.S. Cl. ..... 510/182; 510/499; 510/505; 510/506; 510/405

[58] Field of Search ..... 510/182, 499, 510/505, 405, 506

[56] References Cited

U.S. PATENT DOCUMENTS

| | | | |
|---|---|---|---|
| 3,453,735 | 7/1969 | Stonebraker et al. . | |
| 3,463,735 | 8/1969 | Stonebraker et al. | 510/182 |
| 3,819,522 | 6/1974 | Zmoda et al. | 510/182 |
| 3,839,234 | 10/1974 | Roscoe . | |
| 3,939,090 | 2/1976 | Zmoda . | |
| 4,315,828 | 2/1982 | Church . | |
| 5,108,660 | 4/1992 | Michael . | |
| 5,252,245 | 10/1993 | Garabedian, Jr. et al. | 510/182 |
| 5,415,811 | 5/1995 | Wile et al. | 510/182 |

FOREIGN PATENT DOCUMENTS

| | | |
|---|---|---|
| 889271 | 3/1969 | Canada . |
| 0 527 624 A2 | 10/1992 | European Pat. Off. . |

*Primary Examiner*—Jacqueline V. Howard
*Attorney, Agent, or Firm*—Laura L. Bozek

[57] ABSTRACT

An aqueous glass cleaning composition with optimal anti-streaking properties contains a nonvolatile organic ether having the formula $$R_1—O—R_2$$

wherein $R_1$ is a $C_1$–$C_8$ linear, branched or cyclic alkyl or alkenyl optionally substituted with —OH, and $R_2$ is a $C_1$–$C_6$ linear, branched or cyclic alkyl or alkenyl substituted with —OH; and an anti-streaking alcohol having the formula wherein A, D, E, G, L and M are independently —H, —$CH_3$, —OH or —$CH_2OH$; J is a single bond or —O—; and Q is —H or a straight chain $C_1$–$C_5$ alkyl optionally substituted with —OH.

12 Claims, 4 Drawing Sheets

GLASS CLEANER WITH ENHANCED ANTI-STREAKING PROPERTIES

BACKGROUND OF THE INVENTION

1. Field of the Invention

The present invention relates to compositions for cleaning glass surfaces. In particular, the present invention relates to improved anti-streaking glass cleaning compositions.

2. Brief Description of the Background Art

It is commonly understood that good glass cleaners provide various disparate characteristics within a single composition. These characteristics optimally include good detergency, acceptable evaporability, streak-resistance and the like. In view of the often contradictory nature of these features, it has proven difficult to produce a glass cleaner which attains them all.

Generally, glass cleaners are applied to soiled surfaces to loosen dirt while emulsifying oil and grease. The offending solubilized materials are thereafter wiped from the soiled surface. If the oil and grease are not completely emulsified or are not completely transferred to the wiping material, smearing occurs followed by streaking.

Phosphate detergents are known to provide acceptable cleaning for glass surfaces, however, they are generally perceived by consumers as harmful to the environment.

Typical prior art liquid glass cleaners also utilize a water-based system with a detergent and an organic solvent. For reasons of household safety and commercial acceptance, glass cleaners are nearly universally water-based. Water soluble organic detergents exhibit acceptable detergency, while detergent builders increase detergency by sequestering polyvalent metal ions, these inorganic builders are recognized in the art to cause filming and streaking.

Consumers are highly sensitive to streaking and hazing which may develop on windows and mirrors. A desirable glass cleaner should produce a glass surface which exhibits little or no change in clarity and optical properties from the moment of use and ideally remain that way for weeks and months. In the context of the present invention, streaking can be defined as a visible diffractive layer which causes light scattering. Hazing can be described as a misty diffractive layer that covers the entire glass surface developing instantly or over time, which clouds the view.

Most cleaning products leave behind a thin residual film of product in intimate contact with the silicate glass. Hydrogen bonding to the surface oxides and/or hydroxides with continuous attachment produces an optically clear film. Small breaks or disruptions in these continuous residual films cause diffractive streaks which are visible to the naked eye. Similarly, residual diffractive particles will also be visible to the naked eye. Specific formulation techniques are required to maintain the integrity of a homogeneous residual film and to eliminate residual diffractive particles on the cleaned glass surface.

Chemical and optical stability of the residual surface film may be achieved by maintaining a proper balance of surfactants and coupling agents in the formula. More typically, however, the formulator will prepare a cleaning composition to ensure stability of the composition and the delivery of good detergency without considering the residual film properties and optical effects.

Formulating to improve residual film properties requires knowledge of the formula composition during the dry down process. The volatility of the individual components and their surface interactions as they evaporate at different rates also need to be considered. For example, the addition of n-hexanol to a low solvent amphoteric-based glass cleaner will reduce its propensity to streak and haze since n-hexanol couples well with the residual surfactants and the silicate surface.

Nonvolatile glycol ether-based cleaning formulas represent a completely different coupling problem. Cleaning compositions containing nonvolatile glycol ethers, such as hexyl cellosolve (ethylene glycol n-hexyl ether) or butyl cellosolve (ethylene glycol n-butyl ether) represent a different situation because hexyl cellosolve and butyl cellosolve are less soluble and less volatile than other formula components. For example, during the dry down process, each of these materials tends to complex with itself, thereby forming small diffractive particles which pull away from the glass and create the phenomenon known as streaking. The breaking of the solid-liquid interface to form small droplet-like particles of hexyl cellosolve or butyl cellosolve occurs with the preferential loss of the coupling agent and total energy.

Applicants have discovered that a glass cleaning composition containing ethylene glycol n-butyl ether is virtually streak free because the glycol ether is coupled with a fluoro surfactant and isopropanol to set up the proper cure and dry down integrity. However, this composition is not as easy for a consumer to use because it does not reduce the lateral or "rub-out" friction created between the cleaning implement such as a paper towel and the glass surface during the cleaning process.

U.S. Pat. No. 3,839,234 relates to cleaning compositions comprising a glycol ether, a glycol, a monohydroxy alcohol, an amine and a synthetic detergent. The synthetic detergent, which is not derived directly from fat or oils, volatilizes and does not leave significant films or detergent residue on surfaces.

U.S. Pat. No. 3,939,090 relates to cleaning compositions comprising a lower alkylene glycol, a lower alkyl monoether such as ethylene glycol monobutyl ether or propylene glycol monomethyl ether and an aliphatic alcohol. Exemplified alcohols are isopropanol, butanol and ethanol.

U.S. Pat. No. 4,315,828 relates to aqueous glass cleaning compositions containing polyethylene glycol or methoxypolyethylene glycol to provide a coating on the glass to repel the emulsified oil and grease, thereby enhancing its transfer to the toweling and providing a streakless cleaner.

U.S. Pat. No. 5,108,660 relates to aqueous glass cleaning compositions containing a hydrocarbyl-amidoalkylene sulfobetaine detergent surfactant to reduce streaking and filming.

SUMMARY OF THE INVENTION

It is an object of the present invention to provide cleaning compositions with good streak-resistance.

This object and other objectives are provided by a novel aqueous composition which comprises a nonvolatile glycol ether and an anti-streaking alcohol.

DETAILED DESCRIPTION OF THE INVENTION

Figure 1:
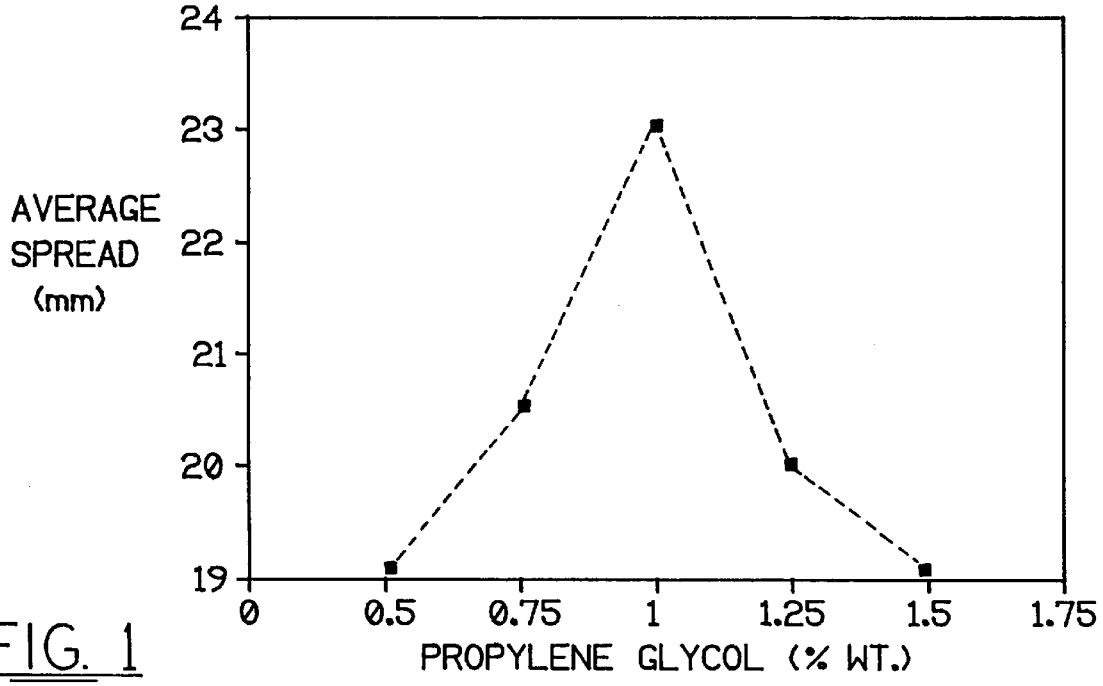
FIG. 1 illustrates the surface wetting properties attained by certain compositions according to the present invention.

The above features and advantages are provided by the present invention of an aqueous cleaning composition comprising a combination of at least one nonvolatile organic ether compound and at least one anti-streaking alcohol compound. If desired, these compositions may also contain one or more of the following: an amphoteric surfactant, a quaternary compound, an organic solvent, coloring and fragrance. The composition may also contain other conventional materials including, but certainly not limited to; ammonia, vinegar, chelating agents, pH modifiers, hydrotropes, anti-microbial compounds, etc.

In order to attain good soil agglomeration, the present invention contains at least one nonvolatile organic ether. The nonvolatile organic ethers according to the present invention are represented by the following Formula (I):

$$R_1—O—R_2$$

wherein $R_1$ is a $C_1$–$C_8$ linear, branched or cyclic alkyl or alkenyl optionally substituted with —OH, —$OCH_3$, or —$OCH_2CH_3$ and $R_2$ is a $C_1$–$C_6$ linear, branched or cyclic alkyl or alkenyl substituted with —OH.

Preferably, $R_1$ is an optionally substituted $C_3$–$C_6$ alkyl or alkenyl, and $R_2$ is a monosubstituted $C_2$–$C_4$ linear or branched alkyl or alkenyl.

More preferably, $R_1$ is an unsubstituted or monosubstituted linear or branched $C_3$–$C_6$ alkyl, and $R_2$ is a monosubstituted $C_2$–$C_4$ linear or branched alkyl.

Most preferably, $R_1$ is an unsubstituted n-$C_3$–$C_4$ or n-$C_6$ linear alkyl or $$-CH_2\underset{\underset{OH}{|}}{C}HCH_3,$$

and $R_2$ is —$CH_2CH_2OH$ or $$-CH_2\underset{\underset{OH}{|}}{C}HCH_3.$$

Suitable nonvolatile glycol ethers include ethylene glycol n-hexyl ether, ethylene glycol n-butyl ether, dipropylene glycol methyl ether, propylene glycol n-butyl ether and propylene glycol n-propyl ether. However, since ethylene-based glycol ethers may be considered hazardous in the future and/or environmental air pollutants based on their degradation products or toxicity, the propylene-based glycol ethers may be better suited for residential cleaning compositions, particularly when intended for indoor use. One commercially available nonvolatile glycol ether is Dow Triad which is an equal weight percentage mixture of dipropylene glycol methyl ether, propylene glycol n-butyl ether and propylene glycol n-propyl ether commercially available from Dow Chemicals.

In the present invention, the nonvolatile glycol ether(s) can be contained in any amount desired. Generally, these amounts will be selected to achieve good cleaning results and are commonly in the range from about 0.1 to about 5.0 total weight percent (hereinafter, all amounts are given in weight percent unless specified otherwise). Preferably, the nonvolatile glycol ether is employed in the range from about 0.5 to about 3.0 total weight percent and most preferably, from about 0.9 to about 2.5 total weight percent.

This invention relates to the discovery that certain alcohols couple with the nonvolatile organic ethers and markedly reduce the potential of glass cleaning compositions to develop visible streaks as well as to enhance the ease of use by the consumer. These anti-streaking alcohols include various monohydric alcohols, dihydric alcohols, trihydric alcohols and polyhydric alcohols.

The anti-streaking alcohols for use in the present invention are represented by the following Formula (II):

$$\begin{array}{ccccccc} & A & & E & & L & \\ & | & & | & & | & \\ H- & C & - & C & -J- & C & -Q \\ & | & & | & & | & \\ & D & & G & & M & \end{array} \qquad \text{(II)}$$

wherein A, D, E, G, L and M are independently —H, —$CH_3$, —OH or —$CH_2OH$; J is a single bond or —O—; and Q is —H or a straight chain $C_1$–$C_5$ alkyl optionally substituted with —OH, with the proviso that:

(i) if Q is not an alkyl substituted with —OH, then at least one of A, D, E, G, L and M is —OH or —$CH_2OH$;

(ii) when only one of A and E is —OH and J is a single bond, D, G, L, M and Q may not be —H simultaneously;

(iii) when A, D, E, G and L are —H simultaneously, J is a single bond and M is —$CH_2OH$, Q may not be —H or $$-\underset{\underset{OH}{|}}{C}HCH_2CH_2CH_3;\text{ and}$$

and (iv) when J is single bond, none of E, G, L and M is —$CH_3$ or —$CH_2OH$ and Q is —$CH_2CH_2CH_2CH_3$, then at least two of A, D, E, G, L and M are —OH; or at least one of A and D is —CH or —$CH_2OH$.

Preferably, at least one of A, D, E and G is —OH or —$CH_2OH$ and Q is —H or a straight chain $C_1$–$C_5$ alkyl optionally monosubstituted with —OH.

More preferably, one or two of A, D, E and G is —OH or —$CH_2OH$ and Q is —H or —$CH_2OH$.

Most preferably, one or two of A, D, E and G is —OH or —$CH_2OH$, J is —O—, L and M are independently —H or —$CH_3$ and Q is —$CH_2OH$.

The inventors have found that propylene glycol (1,2-propanediol), glycerin (1,2,3-propanetriol), n-hexanol, 1-pentanol, 2-pentanol, 3-pentanol, 1,3-butylene glycol (1,3 butanediol) and diethylene glycol (dihydroxy diethyl ether) function especially well to adequately couple the nonvolatiles.

Other alcohols were found functionally not to reduce streaking characteristics. These include 2-ethyl-1,3-hexanediol, 2,2,4-trimethyl-1,3-pentanediol, 1-heptanol, 2-heptanol and 3-heptanol.

The inventors have observed that the properly coupled cleaning compositions facilitate soil removal with minimum soil redeposition. Nonvolatile organic ether-based formulas have the tendency to form stable agglomerates which may not preferentially absorb into the cleaning towel substrate. Maintaining the proper surface energy with stable alcohol solutions maximizes soil pick up and deposition on the towel substrate with a minimum of redeposition on the solid surface.

In the present invention, the anti-streaking alcohol(s) will be employed in any desired amounts. Generally, these amounts will be selected to achieve reduction in streaking and/or hazing and are commonly in the range of from about 0.1 to about 5.0 total weight percent. Preferably, the anti-streaking alcohol is employed in the range of from about 0.1 to about 3.5 total weight percent and most preferably, from about 0.2 to about 2.5 total weight percent.

Surprisingly, the amount of streak reduction provided by the anti-streaking alcohol is not a linear function with increasing amounts of anti-streaking alcohol but is instead a gaussian-shaped curve in which approximately equal parts of alcohol to the formula nonvolatiles produces the least amount of streaking.

The inventors have determined that surface wetting and contact angle are good measures of potential long term film stability for nonvolatile glycol ether containing glass cleaners. These performance indices are both measured by placing a single drop (ca. 0.04 gr. or 5 $\mu$l, respectively) of the test product from a pipette onto an untreated mirror and/or glass surface.

FIG. 1 shows a non-linear curve illustrating surface wetting measurements taken from glass cleaning compositions containing 0.9 weight percent ethylene glycol n-hexyl ether and varying amounts of propylene glycol. A control cleaning composition containing 0.9 weight percent ethylene glycol n-hexyl ether provided surface wetting spread of 21 mm.

Figure 2:
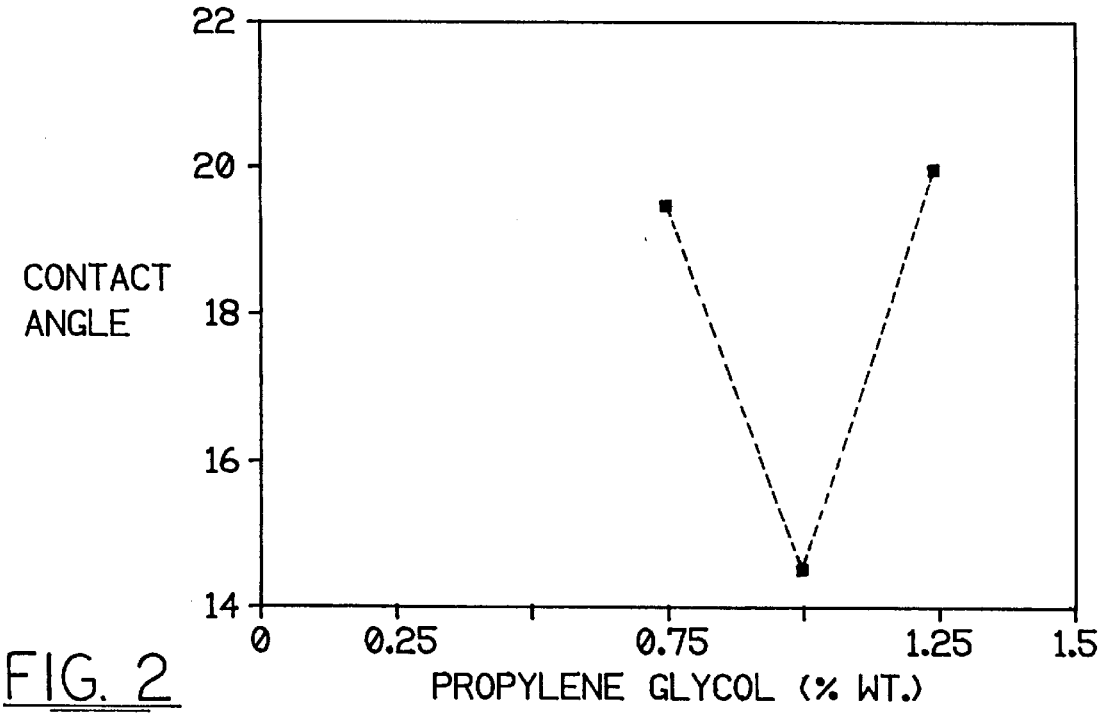
FIG. 2 illustrates contact angle properties attained by certain compositions according to the present invention.

FIG. 2 shows a non-linear curve illustrating contact angle measurements taken from glass cleaning compositions containing 0.9 weight percent ethylene glycol n-hexyl ether and varying amounts of propylene glycol. A control cleaning composition containing 0.9 weight percent ethylene glycol n-hexyl ether provided a contact angle of 22°.

FIG. 1 illustrates that surface wetting obtained upon application of the glass cleaner reaches a maximum when the amount of streak reducing alcohol is similar to the amount of nonvolatile glycol ether. Moreover, FIG. 2 also illustrates that the contact angle obtained upon application of the glass cleaner reaches its minimum when the amount of streak reducing alcohol is approximately the same as the amount of nonvolatile glycol ether. Without being bound by this explanation, the inventors believe it is most effective to formulate the glass cleaner so as to maximize the average spread while minimizing the contact angle.

The glass cleaning compositions according to the present invention may contain one or more surfactants to adjust the surface tension of the composition. These surfactants may preferably include cationic fluoro surfactants such as 3M Fluorad® FC-135, anionic surfactants such as decyl (sulfophenoxy) benzenesulfonic acid disodium salt sold by Dow Corp. as Dowfax® C10L or amphoteric surfactants such as caprylic glycinate sold by Witco Corp. as Rewoteric® AMV. The anionic surfactant may also be a fluoro anionic surfactant such as 3M Fluorad® FC-129. Other suitable surfactants include betaine surfactants such as coco amido propyl dimethyl sultaine sold by Lonza Corp. as Lonzaine® CS, coconut based alkanolamide surfactants sold by Mona Chemicals as Monamid® 150-ADD or ethoxylated alcohols such as Neodol® 23-3 (Shell Chemicals), low foaming surfactants such as lauramine oxide sold by Lonza Corp. as Barlox® LF and cleaning surfactants such as ethoxylated vegetable oil sold by GAF Corp. as Emulphor® EL-719.

Generally, the inventors have found that the use of cationic amphoteric surfactants may result in glass cleaners which have a tendency for streaking or smearing problems. Accordingly, amphoteric surfactants used in the present invention are preferably employed under alkaline conditions to render the anionic portion of the amphoteric compound active.

Ideally, the amphoteric surfactant exhibits high detergency and low foam characteristics. Suitable examples of such amphoteric compounds include a capryloamphodipropionate such as Amphoterge® KJ-2 (Lonza Corp.) which has a lipophilic end with a chain length including the amide carbon of $C_6$ (4%); $C_8$ (57%); $C_{10}$ (38%) and $C_{12}$ (1%.).

The amphoteric surfactants may desirably be utilized in their salt-free forms to maximize their compatibility in the glass cleaning systems; particularly if the glass cleaner contains detergents.

In the present invention, the surfactant(s) will be employed in the range from 0 to about 5.0 weight percent, preferably in the range of from about 0.01 to about 3.0 weight percent and most preferably in the range of from about 0.01 to about 2.0 weight percent.

The glass cleaning compositions according to the present invention may also contain a quaternary compound which enhances the anti-fog activity of the amphoteric surfactant. Such compounds include any conventional quaternary ammonium salt compound in which a positively charged central nitrogen atom is joined to four organic groups associated with a negatively charged acid radical. The quaternary compounds are also intended to include other positively charged tetravalent nitrogen atom salts, including betaines and sulfobetaines. Preferable quaternary compounds include an ethyl bis (polyethoxy ethanol) such as Variquat® 66 and K-1215 from Witco Corp. Variquat® 66 and K-1215 are known generically as tallow ammonium chloride.

Typically, glass cleaning compositions prepared in conformity with this invention will contain from 0 to about 2.0 weight percent quaternary compound, preferably from about 0.075 to about 1.0 weight percent quaternary compound and most preferably, from about 0.1 to about 0.75 weight percent quaternary compound.

The glass cleaning compositions may also provide antimicrobial and/or disinfectant compounds including quaternary ammonium compounds, such as alkyl dimethyl benzyl/diallyl dimethyl ammonium chloride sold by Lonza Corp. as Bardec® 208M. The formulator may also choose to include one or more cleaning solvents or cleaning supplements such as monoethanolamine. These cleaning solvents will typically be utilized in amounts from 0 to about 2.0 weight percent, preferably from about 0.01 to about 1.0 weight percent and most preferably, from about 0.125 to about 0.8 weight percent.

The glass cleaning compositions according to the present invention may also contain cleaning aids such as sodium metasilicate ($Na_2SiO_3$), which is useful for improving the removal of various types of stains and penetrating soils, or gluconic acid ($HOCH_2(CH(OH))_4CO_2Na$), which improves cleaning, provides sequestering, and promotes rust removal. These cleaning aids will typically be utilized in amounts of from 0 to about 1.0 weight percent, preferably from about 0.01 to about 0.80 weight percent and most preferably, from about 0.1 to about 0.5 weight percent.

For better consumer acceptance, the glass cleaning composition will typically contain colorant or dye, such as Direct Blue 86, Liquitint® or Blue HP and a fragrance component. If a dye or a fragrance is contained in the composition, it may be preferable also to include an anti-oxidant, such as potassium iodide, to protect these materials and provide sufficient stability for a long shelf life. Of course, it is certainly possible for commercial or other reasons to provide a clear or fragrance-free composition by omitting these materials.

Compositions of the present invention may have any desired pH. However, preferred compositions according to the present invention are basic in order to cause any amphoteric surfactant which may be present to become more anionic and more hydrophilic. Of course, the particular pH selected may depend greatly upon any individual surfactant which is utilized. Generally, however, the pH of the composition is above 7, more preferably from 8–13 and ideally from 10–11.

EXAMPLES

The following compositions are either Illustrative Examples of various representative embodiments of the present invention or Comparative Examples thereof.

Example 1

An anti-streak glass cleaning composition according to the present invention was prepared according to the following formula:

| | |
|---|---|
| Sodium dodecyl benzene sulfonate | 0.2000 |
| Monoethanolamine | 0.2000 |
| Ethylene glycol n-hexyl ether | 0.9000 |
| Ethylene glycol n-butyl ether | 1.0000 |
| Isopropyl alcohol | 4.2500 |
| 1,3-Butylene glycol | 0.7500 |
| Anionic fluoro surfactant | 0.0250 |
| Fragrance | 0.0500 |
| Potassium iodide | 0.0030 |
| Dye | 0.0007 |
| Ammonia (28.5% active) | 0.3000 |
| Deionized water | balance |

Example 2

An anti-streak disinfecting glass cleaning composition according to the present invention was prepared according to the following formula:

| | |
|---|---|
| Lauramine oxide | 0.4000 |
| Glycerin | 0.2000 |
| Alkyl dimethyl benzyl/dialkyl dimethyl ammonium chloride (80% active) | 0.1200 |
| Monoethanolamine | 0.4000 |
| Hexanol | 0.3000 |
| Isopropyl alcohol | 2.5000 |
| Propylene glycol n-butyl ether | 0.2500 |
| Cationic fluoro surfactant | 0.0500 |
| Fragrance | 0.0500 |
| Deionized water | balance |

Example 3

An anti-streak glass cleaning composition according to the present invention was prepared according to the following formula:

| | |
|---|---|
| Decyl (sulfophenoxy) benzenesulfonic acid disodium salt | 0.1500 |
| Monoethanolamine | 0.2000 |
| Ethylene glycol n-hexyl ether | 0.6000 |
| Ethylene glycol n-butyl ether | 0.8000 |
| Isopropyl alcohol | 3.5000 |
| Anionic fluoro surfactant | 0.0250 |
| Fragrance | 0.0500 |
| Propylene glycol | 0.2500 |
| Dye | 0.0014 |
| Ammonia (28.5% active) | 0.3000 |
| Soft water | balance |

Example 4

An anti-streak glass cleaning composition according to the present invention was prepared according to the following formula:

| | |
|---|---|
| Sodium dodecyl benzene sulfonate | 0.2000 |
| Monoethanolamine | 0.2000 |
| Ethylene glycol n-hexyl ether | 0.7000 |
| Ethylene glycol n-butyl ether | 0.5500 |
| Isopropyl alcohol | 4.0000 |
| Propylene glycol | 1.0000 |
| Anionic fluoro surfactant | 0.0250 |
| Fragrance | 0.0500 |
| Dye | 0.0014 |
| Ammonia (28.5% active) | 0.3000 |
| Soft water | balance |

Example 5

An anti-streak glass cleaning composition according to the present invention was prepared according to the following formula:

| | |
|---|---|
| Sodium dodecyl benzene sulfonate | 0.2000 |
| Monoethanolamine | 0.2000 |
| Ethylene glycol n-hexyl ether | 0.7000 |
| Ethylene glycol n-butyl ether | 0.5500 |
| Isopropyl alcohol | 4.0000 |
| Propylene glycol | 1.0000 |
| Anionic fluoro surfactant | 0.0250 |
| Fragrance | 0.0500 |
| Dye | 0.0014 |
| Sodium metasilicate, anhy drous | 0.2500 |
| Ammonia (28.5% active) | 0.3000 |
| Soft water | balance |

Example 6

An anti-streak glass cleaning composition according to the present invention was prepared according to the following formula:

| | |
|---|---|
| Sodium dodecyl benzene sulfonate | 0.2000 |
| Monoethanolamine | 0.2000 |
| Ethylene glycol n-hexyl ether | 0.7000 |
| Ethylene glycol n-butyl ether | 0.5500 |
| Isopropyl alcohol | 4.0000 |
| Propylene glycol | 1.0000 |
| Anionic fluoro surfactant | 0.0250 |
| Fragrance | 0.0500 |
| Dye | 0.0014 |
| $Na_2SiO_3.5H_2O$ | 0.2500 |
| Ammonia (28.5% active) | 0.3000 |
| Soft water | balance |

Example 7

An anti-streak glass cleaning composition according to the present invention was prepared according to the following formula:

| | |
|---|---|
| Sodium dodecyl benzene sulfonate | 0.2000 |
| Monoethanolamine | 0.2000 |
| Ethylene glycol n-hexyl ether | 0.7000 |
| Ethylene glycol n-butyl ether | 0.5500 |
| Isopropyl alcohol | 4.0000 |

-continued

| | |
|---|---|
| Propylene glycol | 1.0000 |
| Anionic fluoro surfactant | 0.0250 |
| Fragrance | 0.0500 |
| Dye | 0.0014 |
| Gluconic acid | 0.2500 |
| Ammonia (28.5% active) | 0.3000 |
| Soft water | balance |

Example 8

A composition was prepared with the following formula:

| Ingredient Name | % w/w |
|---|---|
| Isopropyl Alcohol, Anhydrous | 3.500000 |
| Ethylene Glycol Monobutyl Ether | 1.000000 |
| Ethylene Glycol N-Hexyl Ether | 0.900000 |
| Ammonium Hydroxide | 0.300000 |
| Propylene Glycol, Industrial Grade | 0.250000 |
| Sodium Dodecyl Benzene Sulfonate | 0.200000 |
| Caustic Soda, 50% Liquid | 0.060000 |
| Fragrance | 0.050000 |
| Dye | 0.000700 |
| Cationic fluoro surfactant | 0.020000 |
| Soft Water | balance |

Comparative Example 1

A composition was prepared according to the following formula:

| | |
|---|---|
| Sodium dodecyl benzene sulfonate | 0.2000 |
| Monoethanolamine | 0.2000 |
| Ethylene glycol n-hexyl ether | 0.9000 |
| Ethylene glycol n-butyl ether | 1.0000 |
| Isopropyl alcohol | 3.5000 |
| 2-Ethyl-1,3-hexanediol | 1.5000 |
| Anionic fluoro surfactant | 0.0250 |
| Fragrance | 0.0500 |
| Potassium iodide | 0.0030 |
| Dye | 0.0007 |
| Ammonia (28.5%) | 0.3000 |
| Deionized water | balance |

Comparative Example 2

A composition was prepared according to the following formula:

| | |
|---|---|
| Capryloamphodipropionate | 0.2500 |
| Caprylic Glycinate | 0.4500 |
| Monoethanolamine | 0.4000 |
| Ethyl lactate | 1.0000 |
| Ethyl bis (polyethoxy ethanol) tallow ammonium chloride | 0.2000 |
| Cationic fluoro surfactant | 0.0200 |
| Fragrance | 0.0600 |
| Dye | 0.0007 |
| Ammonia (28.5%) | 0.2200 |
| Deionized water | balance |

Comparative Example 3

A composition was prepared according to the following formula:

| | |
|---|---|
| Capryloamphodipropionate | 0.2500 |
| Caprylic Glycinate | 0.4500 |
| Monoethanolamine | 0.4000 |
| 2-ethyl-1,3-hexanediol | 1.0000 |
| Ethyl bis (polyethoxy ethanol) tallow ammonium chloride | 0.2000 |
| Cationic fluoro surfactant | 0.0200 |
| Fragrance | 0.0600 |
| Dye | 0.0007 |
| Ammonia (28.5%) | 0.2200 |
| Deionized water | balance |

Comparative Example 4

A composition was prepared according to the following formula:

| | |
|---|---|
| Sodium lauryl sulfate | 0.5000 |
| Capryloamphodipropionate | 0.6500 |
| Ethyl bis (polyethoxy ethanol) tallow ammonium chloride | 0.4500 |
| Monoethanolamine | 0.4000 |
| Anionic fluoro surfactant | 0.0250 |
| Fragrance | 0.0400 |
| Dye | 0.0007 |
| Ammonia (28.5%) | 0.2500 |
| Deionized water | balance |

Comparative Example 5

A composition was prepared according to the following formula:

| | |
|---|---|
| Lauramine oxide | 0.4000 |
| Alkyl dimethyl benzyl/dialkyl dimethyl ammonium chloride | 0.1200 |
| Monoethanolamine | 0.4000 |
| Isopropyl alcohol | 2.5000 |
| Propylene glycol N-butyl ether | 0.2500 |
| Cationic fluoro surfactant | 0.0500 |
| Fragrance | 0.0500 |
| Deionized water | balance |

Comparative Example 6

A composition was prepared according to the following formula:

| | |
|---|---|
| Capryloamphodipropionate | 0.2500 |
| Caprylic gylcinate amphoteric surfacant | 0.4500 |
| Ethyl bis (polyethoxy ethanol) tallow ammonium chloride | 0.2000 |
| Monoethanolamine | 0.4000 |
| Anionic fluoro surfactant | 0.0200 |
| Fragrance | 0.0500 |
| Dye | 0.0004 |
| Ammonia (28.5%) | 0.2200 |
| Deionized water | balance |

Comparative Example 7

A composition was prepared according to the following formula:

| | |
|---|---|
| Sodium dodecyl benzene sulfonate | 0.2000 |
| Monoethanolamine | 0.2000 |
| Ethylene glycol N-hexyl ether | 0.9000 |
| Ethylene glycol N-butyl ether | 1.0000 |
| Isopropyl alcohol | 5.0000 |

-continued

| | |
|---|---|
| Anionic fluoro surfactant | 0.0250 |
| Fragrance | 0.0500 |
| Potassium iodide | 0.0030 |
| Dye | 0.0014 |
| Ammonia (28.5%) | 0.3000 |
| Soft water | balance |

Comparative Example 8

A composition was prepared according to European Patent Application No. 0527625A2:

| | |
|---|---|
| Sodium lauryl sulfate (30%) | 0.34364 |
| Isopropyl alcohol, anhydrous | 2.76000 |
| Ethylene glycol-N-butyl ether | 1.74000 |
| Low molecular weight polyacrylic acid | 0.04200 |
| Anionic fluoro surfactant | 0.01500 |
| Fragrance | 0.02000 |
| Dye | 0.00070 |
| Ammonia (28.5%) | 1.0000 |
| Soft water | balance |

EVALUATION

Glass cleaning compositions are evaluated directly for streaking and hazing by actual use and observation. The streaking/hazing potential of a glass cleaner is evaluated by observing a mirror with direct illumination using bright (300 W/Btu 880) light. While windows and glass panels can also be used to evaluate application performance, angle of view and lighting techniques become more critical. A problem glass cleaner may instantly streak or develop a haze within a few days. These problems can be further complicated by the cleaning process, cleaning towel and specific soil types encountered.

For evaluation by direct observation, mirrors are prepared by cleaning with HPLC grade acetone and wiped with an AccuWipe™ (Fort Howard) or Cheesecloth Wipe™ (VWR). This acetone wash is followed by cleaning with ethanol and a Cheesecloth Wipe™ and dried thoroughly.

Equal amounts of the test products are applied to the prepared mirror surfaces by trigger or aerosol spray or are applied uniformly with an eye dropper at the rate of approximately 1 ml per 6"×12" (15.2 cm×30.5 cm) area.

A folded paper towel is used to rub out the liquid test product with three to four up-and-down strokes followed by two cross strokes. The paper towel is then turned over and its clean side is used in a vertical stroke until the glass is coated with a consistent wet film which is allowed to air dry (referred to in the results as "Wet") or until the glass is completely dry and bright (referred to in the results as "Dry"). Immediately after application, the mirror is observed under a bright spotlight and any streaking is recorded. The mirror is then stored vertically in a controlled test room which is free of chemical and particulate contamination. The mirror is examined periodically for haze development and any other changes at an observation sequence of approximately one hour, 24 hours and then weekly for a period of two months. The treated surfaces are examined with the naked eye for qualitative assessment and with video observation for quantitative evaluation under various light source conditions.

Good products will not streak or haze initially or even after 1 to 2 months under normal conditions. Inferior formulations may streak immediately or with time develop undesirable hazing.

The formulations of all the preceding examples, except Example 8, were evaluated using the foregoing direct observation procedure. The results are illustrated in Table 1 below. In Table 1, streaking and hazing are evaluated on a scale of 1–10, with 1 being optimum (no streaking or hazing) and 10 being the worst possible (immediate streaking or severe hazing).

TABLE 1

| | DRY (avg). | WET (avg.) |
|---|---|---|
| Example 1 | 1.5 | 6.3 |
| Example 2 | 2.0 | 5.3 |
| Example 3 | 1.3 | 2.3 |
| Example 4 | 1.0 | 2.7 |
| Example 5 | 2.0 | 3.0 |
| Example 6 | 4.0 | 5.0 |
| Example 7 | 2.0 | 2.0 |
| Comparative Ex. 1 | 4.3 | 9.3 |
| Comparative Ex. 2 | 4.7 | 8.0 |
| Comparative Ex. 3 | 2.7 | 7.3 |
| Comparative Ex. 4 | 3.0 | 5.0 |
| Comparative Ex. 5 | 4.0 | 7.0 |
| Comparative Ex. 6 | 2.7 | 4.7 |
| Comparative Ex. 7 | 1.3 | 4.0 |
| Comparative Ex. 8 | 2.0 | 2.5 |

Stain-lifting

The thickness of surface layers of soil material on solid substrates before and after application of a cleaning composition can be determined using the technique of ellipsometry. In this technique, circulary polarised, monochromatic light is used to illuminate the target surface and the reflected beam's polarisation is determined using ether a Kerr cell detector or a Nicol prism system. The ellipticity of the reflected beam is then used to calculate the thickness of the surface film from a knowledge of the incident beam's angle of incidence; and the film and substrate refractive indices. Using a computer-controlled X-Y stage, the incident beam can be tracked across the test-piece surface and the thickness profile of the surface film assessed. Such thickness profiles are a measure of the level of soil remaining on the substrate surface after cleaning.

Model Soil

A model soil was prepared according the following formula:

| | |
|---|---|
| 37:63 mixture of Norpar 5/Norpar 7 | 98.5% |
| Synthetic sebum | 0.5% |
| Clay | 0.5% |
| Technical white oil | 0.5% |

Soiling Procedure

Cleaned glass plates (6"×6") were evenly coated with the model soil so as to achieve a soil loading of 92 mg/sq. in. The soiled plates were left in a fume cupboard overnight to dry.

The following glass cleaning compositions were evaluated:

Comparative Example 9

The following composition was prepared:

| | |
|---|---|
| Ethylene Glycol N-Hexyl Ether | 0.9000 |
| Ethylene Glycol Monobutyl Ether | 1.0000 |
| Isopropyl Alcohol, Anhydrous | 5.0000 |
| Potassium Iodide | 0.0030 |
| Sodium Dodecyl Benzene Sulphonate (20% active) | 0.4000 |
| Monoethanolamine | 0.4000 |
| Anionic Fluoro surfactant | 0.0250 |
| Acetic Acid (80%) | 0.0375 |
| Fragrance | 0.1000 |
| Ammonia (28.5%) | 0.3528 |
| Deionized Water | balance |

Example 9

The following composition was prepared:

| | |
|---|---|
| Isopropyl Alcohol, Anhydrous | 3.5000 |
| Ethylene Glycol n-Butyl Ether | 0.8000 |
| Ethylene Glycol n-Hexyl Ether | 0.6000 |
| Propylene Glycol | 0.2500 |
| Decyl (sulfophenoxy) benzenesulfonic acid disodium salt | 0.1500 |
| Monoethanolamine | 0.2000 |
| Ammonium Hydroxide | 0.3000 |
| Cationic fluoro surfactant | 0.0250 |
| Fragrance | 0.0500 |
| Dye | 0.0014 |
| Soft Water | balance |

Formula 409® Glass & Surface

A commercial formula under the tradename Formula 409® from the Clorox Co. was analyzed and is believed to have the following composition:

| | |
|---|---|
| Isopropanol | 5.4 |
| Propylene Glycol t-Butyl Ether | 4–5% |
| Ammonium Hydroxide | Present |
| Cocoamidopropyl Betaine | 0.26 |
| Water, Dye and Fragrance | Approx. 90% |

Cleaning Procedure

The various glass cleaning samples were loaded into separate trigger spray applicators that have been checked to ensure that they delivered approximately the same amount of product per activation. Each sample was then used to treat a soiled plate using one full trigger activation to cover the whole plate surface. The treated plates were then left for 30 seconds and cleaned using a Gardner Apparatus. This cleaning involved wrapping a standard paper towel around a 60 mm×30 mm×90 mm wooden block. Each treated plate was then placed in the cleaning tray on the Gardner Apparatus and run for five cycles.

Ellipsometric Measurement

A purpose-built scanning ellipsometer (courtesy of B.P. Research) with a Spectra Physics He/Ne circularly polarised laser source and a Kerr cell type detector was used to determine the residue profiles, as represented by the mean film thickness profile across the glass substrate of the remaining residue after cleaning.

Figure 3:
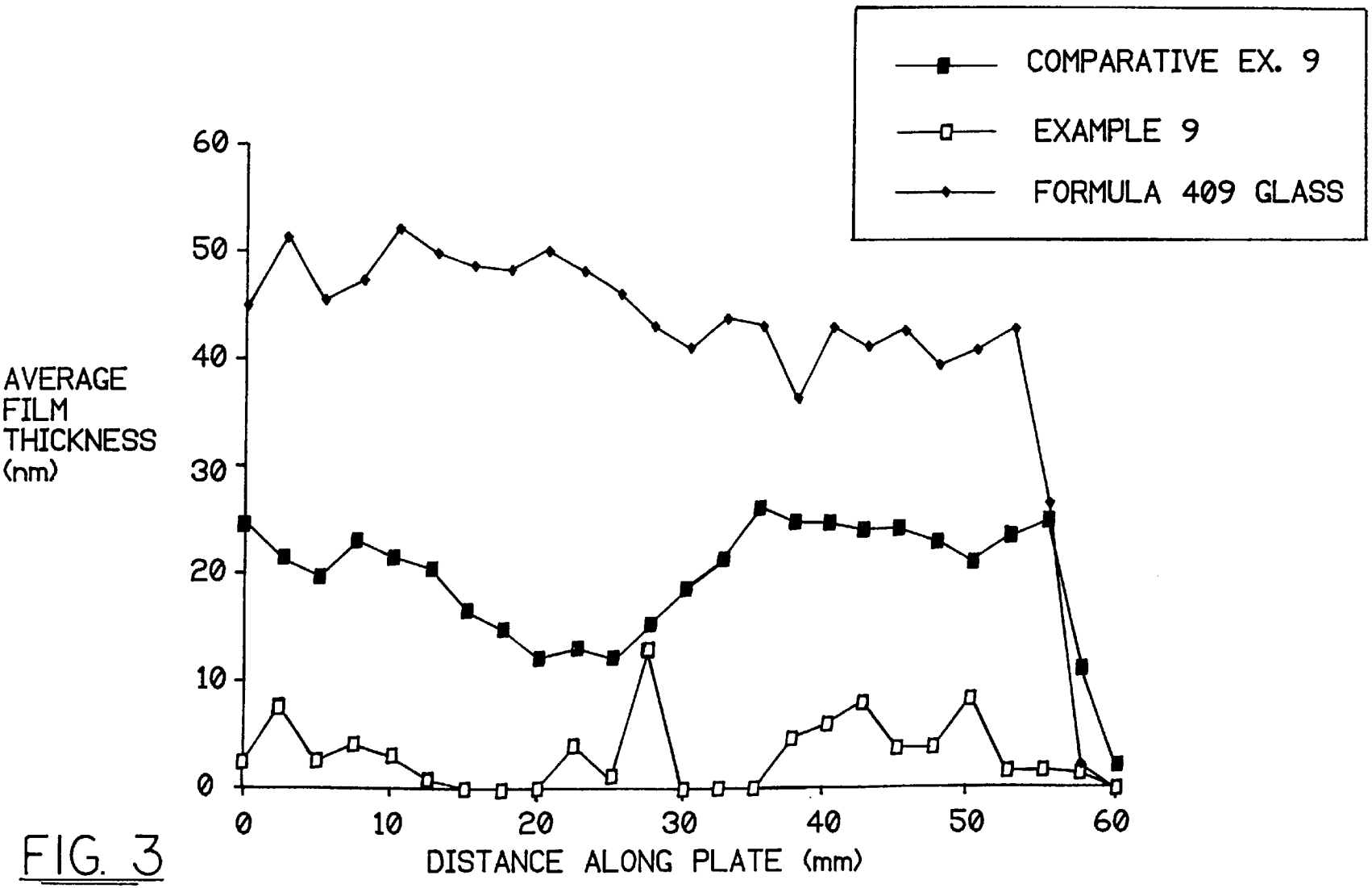
FIG. 3 illustrates mean film thickness profiles of glass surfaces treated with glass cleaning compositions of the present invention and the prior art.

These graphs represented in FIG. 3 correspond to the results obtained during the ellipsometric scan of a cleaned 60 mm×10 mm on the glass plate.

The residue profiles shown in FIG. 3 represent Example 9 of the present invention, Comparative Example 9, and Formula 409® Glass and Surface.

Results

FIG. 3 shows the average thickness profiles for the five products tested, namely Comparative Example 9; Example 9 of the present invention; and Formula 409® Glass and Surface.

As clearly shown, the residual film on the Example 9 treated plate is less than that found on the plates treated with the other non-phosphate containing compositions. The overall ranking of the compositions on the basis of average film thickness across the plate is Example 9<Comparative Example 9<Formula 409 Glass and Surface.

It is important to note that a combination of film thickness and film furrowing (shown by point deviation on the graph) actually causes streaking. As a consequence, Example 9 composition containing propylene glycol does not streak to the same extent as the Formula 409® Glass and Surface Cleaner without propylene glycol. This can be confirmed by visual assessment.

Ease of Use:

Applicants have found that the formulations of the present invention enhance the ease of use by the consumer due to a reduction in the rub-out friction between the cleaning implement and the surface. This reduction in rub-out friction can be demonstrated using a Precision Force Scrubber from the ADAM Instrument Co.

The Precision Force Scrubber is a computer controlled mechanical scrubbing and polishing device designed to apply a fixed normal force while monitoring the frictional force throughout the scrubbing action. The number of scrubbing cycles, the acceleration and velocity of the applicator head are displayed and controlled by a graphical display interface. Data gathering and analysis software are provided to allow characterization of the applied forces throughout each back and forth scrubbing stroke and during multiple stroke cycles. Thus, cleaning, polishing, stripping and other such procedures performed by consumers can be reproducibly controlled and sensitively monitored.

The normal force is the downward force applied by the scrubber head. The lateral force represents the forces of friction between the stationary glass mirror and the moving scrubbing towel. This lateral force is also known as "rub-out" friction. The presence of an undesirable high coefficient of static friction or "tack" is represented graphically by a peak in the lateral force graph.

The controlled scrubber head was equipped with two 2" by 4" scrubbers. Strips of 1.5" wide of cotton cleaning cloth were attached to each scrubber head. The machine settings were as follows: normal force was set to 2.5 lbs; velocity 10, acceleration and deceleration 100; 20 back and forth scrubbing cycles with a 6" stroke. Approximately 0.5 grams of each test product (Example 8 and Comparative Example 7) were placed in front of each cleaning pad. This set up provides a machine controlled direct comparison of test products on a standard 12" square glass mirror.

Figure 4:
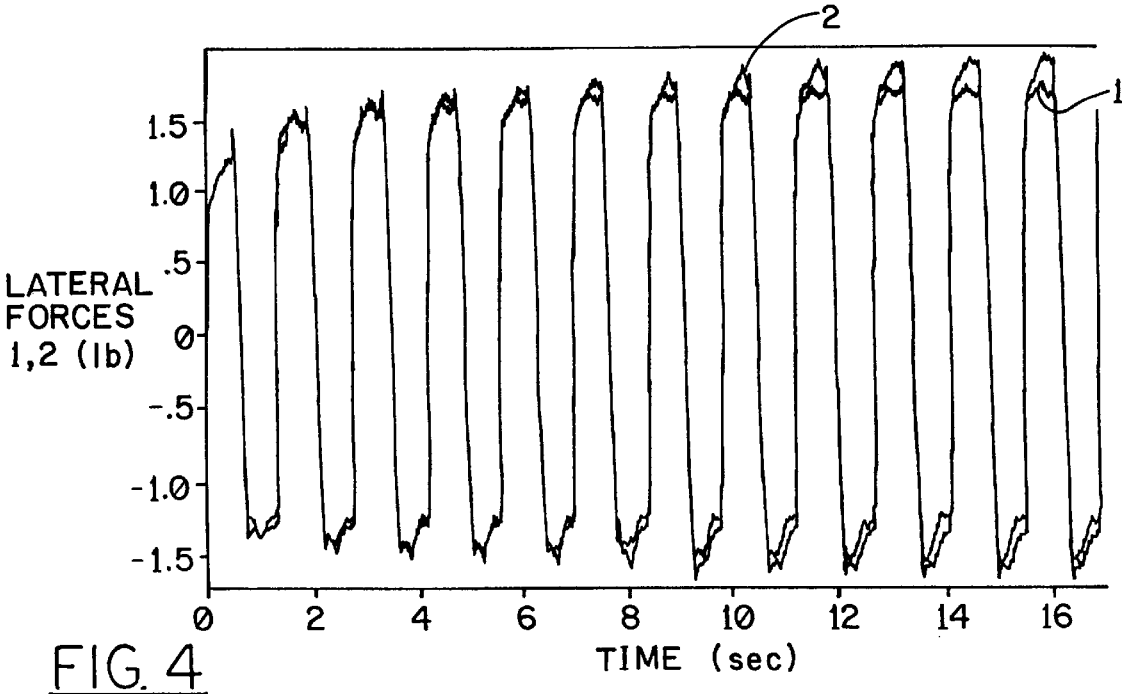
FIGS. 4–6 illustrate the rub-out friction of glass surfaces treated with glass cleaning compositions according to the present invention and the prior art.
Figure 5:
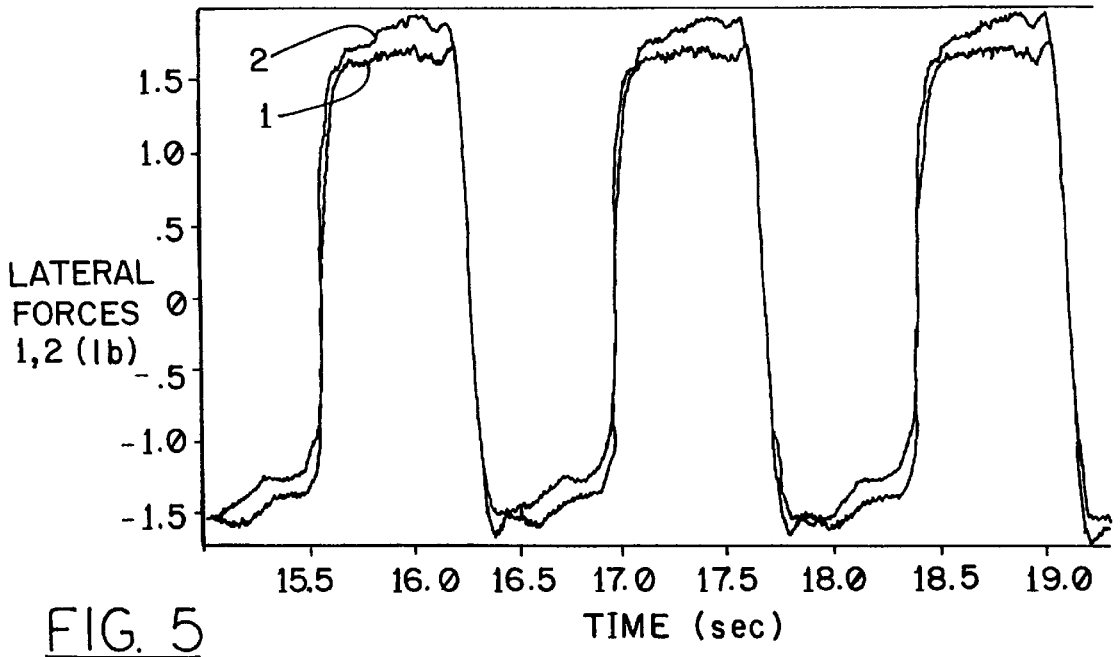
Figure 6:
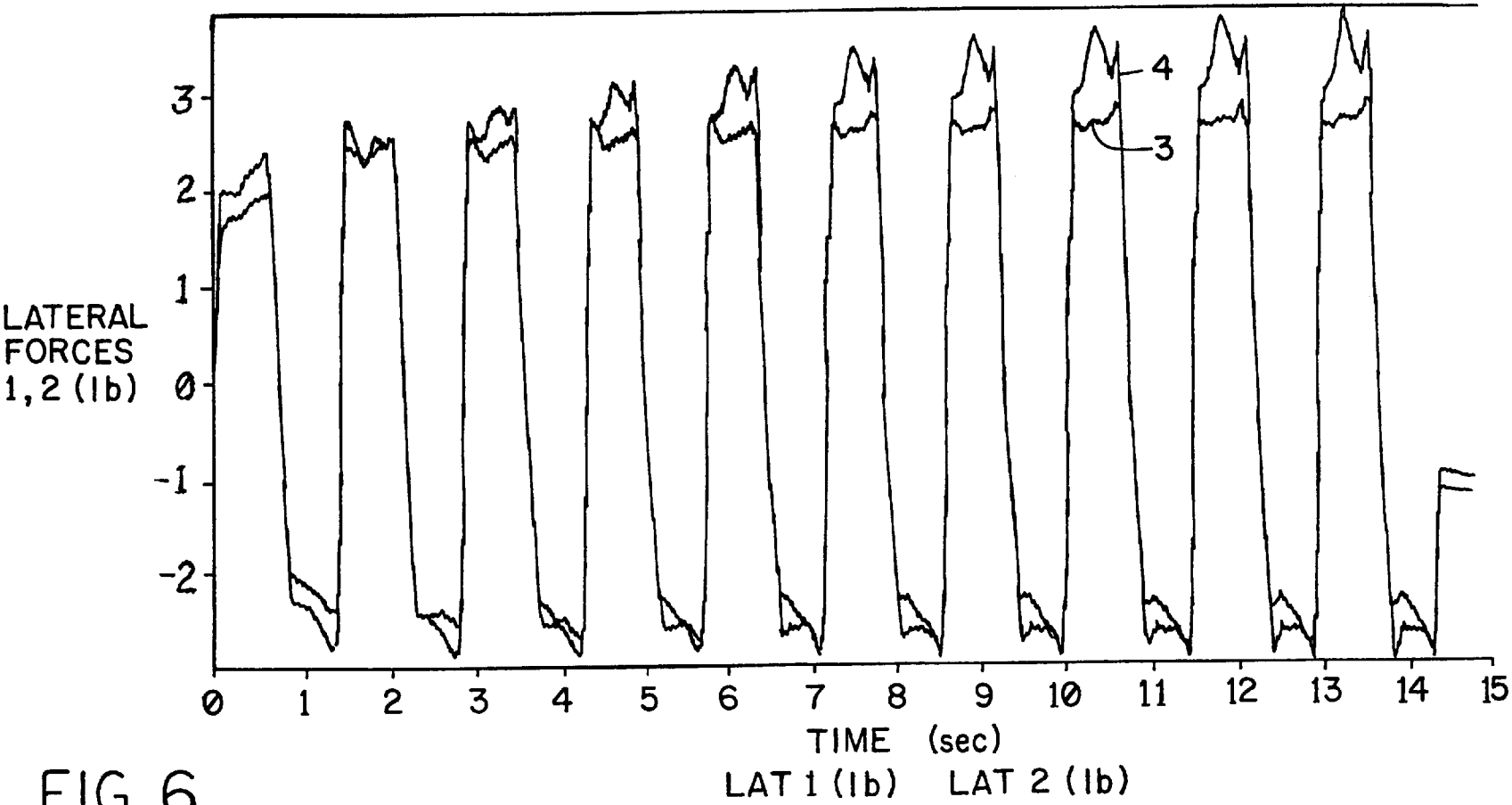

To illustrate the enhanced reduction in rub-out friction of the present invention containing anti-streaking alcohol versus compositions without the anti-streaking alcohol, lateral force (lbs) data from the Precision Force Applicator was plotted against time (sec) as shown in FIGS. 4–6.

FIG. 4 illustrates the rub-out friction for Example 8 of the present invention (plot 1) versus Comparative Example 7 (plot 2 ) for about 12 cycles between 0 and 17 seconds. FIG. 5 illustrates a comparison between the Example 8 of the present invention (plot 1) and Comparative Example 7 (plot 2), of the rub-out friction for 3 cycles between 15 and 19 seconds. As clearly demonstrated in FIGS. 4 and 5, the composition with an anti-streaking alcohol achieved about 0.5 lb reduction in rub-out friction as compared to the composition without an anti-streaking alcohol.

FIG. 6 illustrates the rub-out friction for Example 9 of the present invention containing propylene glycol (plot 3) versus Comparative Example 8 without propylene glycol (plot 4). The test was conducted as described above, with the following exceptions: a 2" by 4" portion of a commercially available paper towel under the tradename Bounty® from the Procter & Gamble Co. was attached to each scrubber head; 1.5 ml of each test product was placed on each paper towel; and 5.0 lbs of normal force was set on the Precision Force Applicator.

As shown in FIG. 6, the Example 9 composition containing propylene (plot 3) exhibited less rub-out friction and less pronounced tack peaks on the glass mirror as compared to the Comparative Example 8 formulation without an anti-streaking alcohol (plot 4).

Although the present invention has been illustrated with reference to certain preferred embodiments, it will be appreciated that the present invention is not limited to the specifics set forth therein. Those skilled in the art will readily appreciate numerous variations and modifications within the spirit and scope of the present invention, and all such variations and modifications are intended to be covered by the present invention which is defined by the following claims.

I claim:

1. A composition for cleaning glass, comprising:

water;

from about 0.01 to about 5.0 weight percent of a nonvolatile organic ether having the formula:

$$R_1—O—R_2$$

wherein $R_1$ is a $C_1$–$C_8$ linear, branched or cyclic alkyl or alkenyl optionally substituted with —OH, and $R_2$ is a $C_1$–$C_6$ linear, branched or cyclic alkyl or alkenyl substituted with —OH; and from about 0.1 to about 5.0 weight percent of an anti-streaking alcohol having formula:

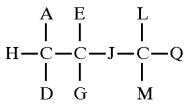

wherein A, D, E, G, L and M are independently —H, —$CH_3$, —OH or —$CH_2OH$; J is a single bond or —O—; and Q is —H or a straight chain or branched $C_1$–$C_5$ alkyl optionally substituted with —OH, with the proviso that:

(i) if Q is not alkyl substituted with —OH, then at least one of A, D, E, G, L and M is —OH or —$CH_2OH$;

(ii) when only one of A and E is —OH and the other is —H, and J is a single bond, then D, G, L, M and Q may not be —H simultaneously;

(iii) when A, D, E and L are —H simultaneously, J is a single bond, one of G or M is —$CH_2OH$ and the other is —H, then Q may not be —H or $$—\underset{\underset{OH}{|}}{CH}CH_2CH_2CH_3;$$

and (iv) when J is a single bond, none of E, G, L and M is —$CH_3$ or —$CH_2OH$ and Q is —$CH_2CH_2CH_2CH_3$, then at least two of A, D, E, G, L and M are —OH, or at least one of A and D is —$CH_3$ or —$CH_2OH$.

2. The glass cleaning composition according to claim 1, wherein $R_1$ is an optionally substituted $C_3$–$C_6$ alkyl or alkenyl, and $R_2$ is a monosubstituted $C_2$–$C_4$ linear or branched alkyl or alkenyl.

3. The glass cleaning composition according to claim 2, wherein $R_1$ is an unsubstituted or monosubstituted linear or branched $C_3$–$C_6$ alkyl, and $R_2$ is a monosubstituted $C_2$–$C_4$ linear or branched alkyl.

4. The glass cleaning composition according to claim 3, wherein $R_1$ is an unsubstituted n-$C_3$–$C_4$ or n-$C_6$ linear alkyl or $$—CH_2\underset{\underset{OH}{|}}{CH}CH_3,$$

and $R_2$ is —$CH_2CH_2OH$ or $$—CH_2\underset{\underset{OH}{|}}{CH}CH_3.$$

5. The glass cleaning composition according to any of claims 1–4, wherein at least one of A, D, E and G is —OH or —$CH_2OH$.

6. The glass cleaning composition according to claim 5, wherein one or two of A, D, E and G is —OH or —$CH_2OH$, and Q is —H or —$CH_2OH$.

7. The glass cleaning composition according to claim 6, wherein J is —O—, L and M are independently —H or —$CH_3$, and Q is —$CH_2OH$.

8. The glass cleaning composition according to claim 6, wherein said nonvolatile organic ether is present in the amount of from about 0.5 to about 3.0 total weight percent and said anti-streaking alcohol is present in the amount of from about 0.1 to about 3.5 total weight percent.

9. The glass cleaning composition according to claim 7, wherein said nonvolatile organic ether is present in the amount of from about 0.9 to about 2.5 total weight percent and said anti-streaking alcohol is present in the amount of from about 0.2 to about 2.5 total weight percent.

10. The glass cleaning composition according to claim 1, further comprising up to about 2.0 weight percent monoethanolamine.

11. The glass cleaning composition according to claim 8, further comprising from about 0.01 to about 1.0 weight percent monoethanolamine.

12. The glass cleaning composition according to claim 9, further comprising from about 0.125 to about 0.8 weight percent monoethanolamine.

* * * * *